US005868432A

United States Patent [19]

Mantegazza

[11] Patent Number: 5,868,432

[45] Date of Patent: Feb. 9, 1999

[54] DOCUMENT WITH ANTI-COUNTERFEITING MEANS TO PREVENT REPRODUCIBILITY BY PHOTOCOPYING

[75] Inventor: Walter Mantegazza, Milan, Italy

[73] Assignee: Mantegazza Antonio Arti Grafiche S.r.l., Ospiate Di Bollate, Italy

[21] Appl. No.: 682,240

[22] Filed: Jul. 17, 1996

[30] Foreign Application Priority Data

Jul. 26, 1995 [IT] Italy ..... MI95A1633

[51] Int. Cl.[6] ..... B42D 15/00

[52] U.S. Cl. ..... 283/94; 283/92; 283/901; 283/902; 283/114

[58] Field of Search ..... 283/902, 94, 85, 283/92, 114, 901, 93

[56] References Cited

U.S. PATENT DOCUMENTS 5,087,507 2/1992 Heinzer ..... 283/902 X
5,271,645 12/1993 Wicker ..... 283/902 X
5,425,978 6/1995 Berneth et al. ..... 283/902 X

FOREIGN PATENT DOCUMENTS 156 463 10/1985 European Pat. Off. .
467067 6/1991 European Pat. Off. ..... 283/902
62 053 7/1891 Germany .
40 22 822 10/1991 Germany .
315 528 5/1928 United Kingdom .

*Primary Examiner*—Frances Han
*Attorney, Agent, or Firm*—Guido Modiano; Albert Josif

[57] ABSTRACT

A document with anti-counterfeiting means to prevent reproducibility by photocopying, having a sheet-like element that has, on its face, at least one region whereon an image that is visible or not visible in the visible-light range is printed and has, on the back, in register with the image provided on the face, the same image, printed with an ink that is not visible in the visible-light range.

10 Claims, 1 Drawing Sheet

DOCUMENT WITH ANTI-COUNTERFEITING MEANS TO PREVENT REPRODUCIBILITY BY PHOTOCOPYING

BACKGROUND OF THE INVENTION

The present invention relates to a document with anti-counterfeiting means to prevent reproducibility by photocopying.

It is known that photocopying machines capable of reproducing any document in the finest of details are currently commercially available. These machines have already been used for the fraudulent duplication of documents, such as for example checks and the like, obtaining a photocopy that is substantially identical to the original and cannot therefore be distinguished easily.

In order to solve this problem, various methods have already been marketed which, for example, produce on the document regions that are not visible within the normal spectrum of visible light but instead appear in the photocopy, thus making the counterfeiting evident.

However, these methods entail considerable complexity during production of the document and accordingly so far they have not been widely adopted.

SUMMARY OF THE INVENTION

A principal aim of the invention is to solve the above problem by providing a document with anti-counterfeiting means to prevent reproducibility by photocopying that allows to produce the document with extremely simple means but providing regions that are visible only in certain conditions and are not captured by the photocopy, so that it is very easy to check the authenticity of the document.

Within the scope of this aim, a particular object of the invention is to provide a document that can be obtained with conventional letterpress printing methods without entailing particular complexity during printing.

Another object of the present invention is to provide a document which, by virtue of its particular production characteristics, is capable of giving the greatest assurances of reliability and security in use.

Another object of the present invention is to provide a document that can be easily obtained starting from commonly commercially available elements and materials and is furthermore competitive from a merely economical point of view.

This aim, these objects, and others which will become apparent hereinafter are achieved by a document with anti-counterfeiting means to prevent reproducibility by photocopying, according to the invention, characterized in that it comprises a sheet-like element having, on its face, at least one region whereon an image visible in the visible-light range is printed and has, on the back, in register with said image provided on the face, the same image, printed with an ink that is not visible in the visible-light range.

BRIEF DESCRIPTION OF THE DRAWINGS

Further characteristics and advantages of the invention will become apparent from the following detailed description of a preferred but not exclusive embodiment of a document with anti-counterfeiting means to prevent reproducibility by photocopying, illustrated only by way of non-limitative example in the accompanying drawings, wherein.

DESCRIPTION OF THE PREFERRED EMBODIMENTS

Figure 1:
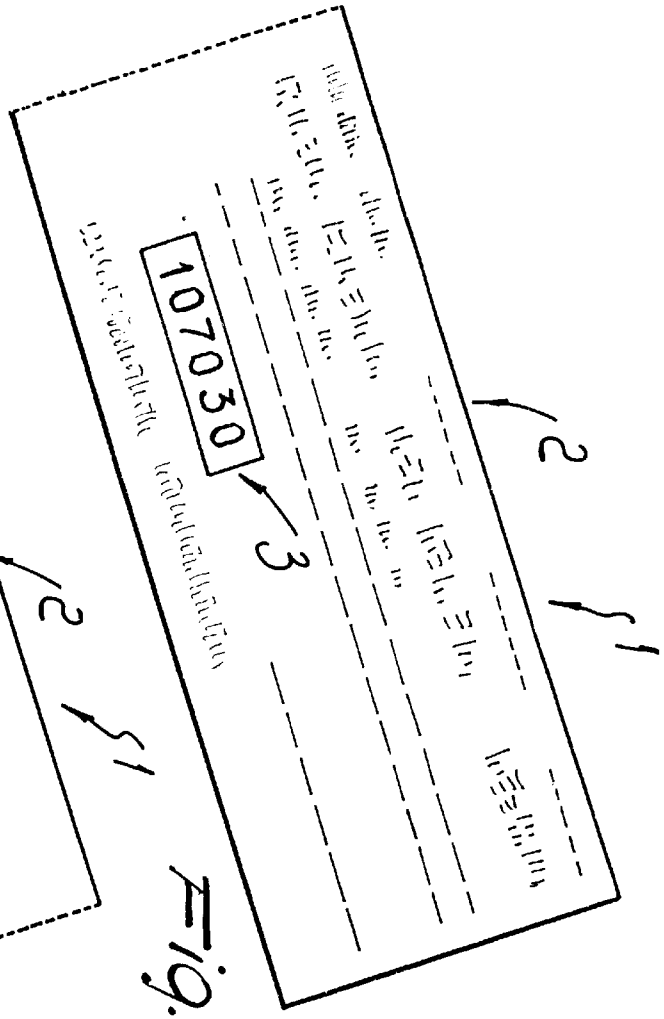
FIG. 1 is a view of the face of the document according to the invention.
Figure 2:
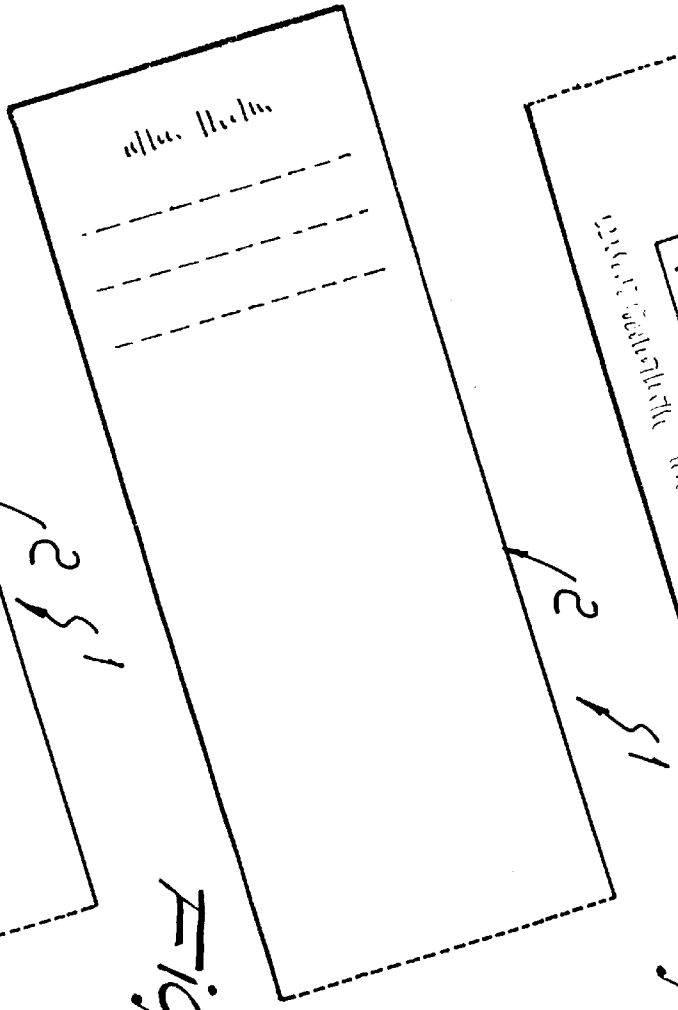
FIG. 2 is a view of the back of the document.

With reference to the above figures, the document with anti-counterfeiting means to prevent reproducibility by photocopying, according to the invention, generally designated by the reference numeral 1, comprises a sheet-like element 2 that is advantageously constituted by a sheet of paper-like material or the like.

A check is shown in the specific case of the drawing, but of course the type of document may be the most disparate.

An important characteristic of the invention resides in the fact that on the face of the sheet-like element 2 there is provided a region where an image 3 visible in the visible-light range is printed by letterpress printing; it is optionally also possible to provide an image 3 that is not visible in the visible-light range.

Merely by way of example, the image, in the accompanying drawing, is constituted by a number, but of course it may be provided by means of any other graphic element printed by letterpress printing. The important characteristic of the invention resides in the fact that on the back of the sheet-like element 2, in perfect register with the image 3 provided on the. face, the same image is printed with an ink that is not visible in the visible-light range, for example an ink of the type visible in ultraviolet light.

The invisible image, designated by the reference numeral 10, is advantageously applied by providing a ribbon impregnated with an ink that is visible in ultraviolet light, which is placed at the back of the sheet-like element 2 and, when the image 3 is produced by letterpress printing, prints the same image in perfect register on the back of the sheet-like element.

Figure 3:
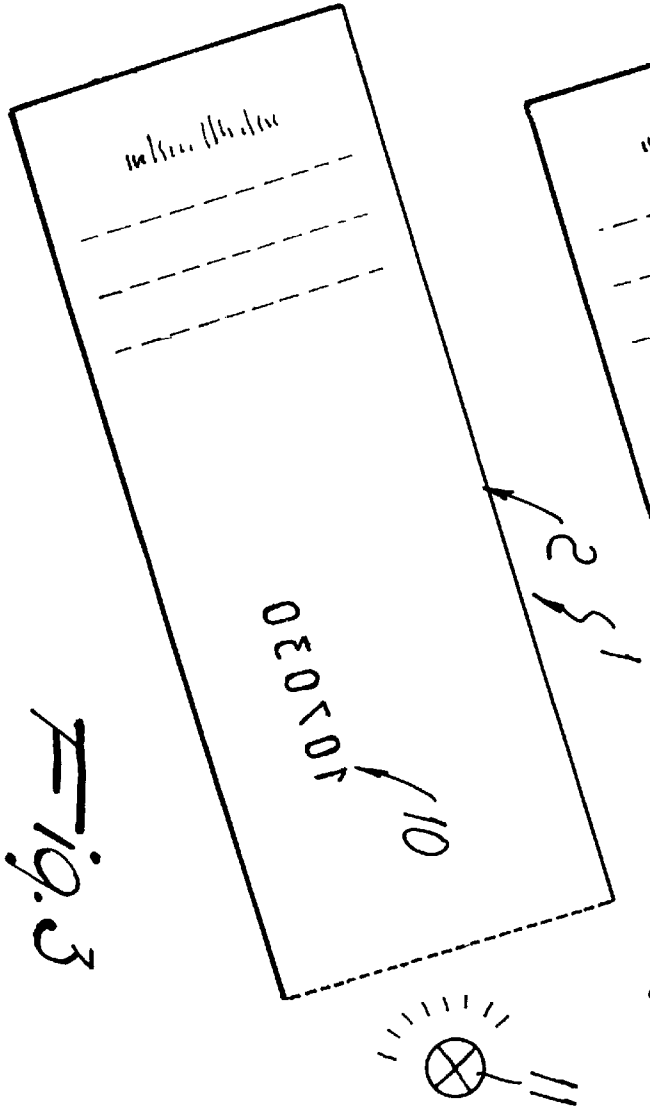
FIG. 3 is a view of the back of the document, lit with an ultraviolet-light lamp.

The image on the back, designated by the reference numeral 10 in FIG. 3, is not visible in the visible-light range, but is instead visible when it is illuminated with an ultraviolet-light lamp, designated by the reference numeral 11 in FIG. 3; it is furthermore possible to provide for different colorings that can be arranged side by side.

With this solution, therefore, it is possible to have a document that cannot be reproduced by photocopying, since the photocopier, despite being able to produce a practically perfect reproduction, is unable to put the images on the face and on the back in register and most of all is unable to photocopy the image provided on the back, since it is an image not visible in the visible-light range because it is obtained with an ultraviolet-light ink.

Accordingly, even if the photocopier were able to detect the image, it would print it off register and visibly on the document, thus clearly showing that counterfeiting has occurred.

In summary, by using a document in which an image is obtained on the back with an invisible ink by interposing a ribbon impregnated with invisible ink at the back of the sheet-like element, also the image on the back is obtained directly during printing of the image on the face.

From the above description it is thus evident that the invention achieves the intended aim and objects, and in particular the extremely simple production of the document, combined with its great functionality, are stressed once more.

The invention thus conceived is susceptible of numerous modifications and variations, all of which are within the scope of the inventive concept.

All the details may furthermore be replaced with other technically equivalent elements.

In practice, the materials employed, as well as the contingent shapes and dimensions, may be any according to the requirements.

What is claimed is:

1. A document with anti-counterfeiting means to prevent reproducibility by photocopying, comprising a sheet-like element having, on its face, at least one region whereon an image that is visible in the visible-light range is printed and has, on the back, in register with said image provided on the face, the same image, printed with an ink that is not visible in the visible-light range, said image printed on the back of the sheet-like element and the image printed on the face of the sheet-like element being printed such that the two images are one coincident with the other.

2. A document according to claim 1, wherein said ink that is not visible in the visible-light range is constituted by an ink visible in ultraviolet light.

3. A document according to claim 1, wherein said ink has different colorings in laterally adjacent regions.

4. A document according to claim 1, wherein said image provided on the back is visible by lighting with an ultraviolet-light lamp.

5. A document according to claim 1, wherein said image provided on the back cannot be reproduced by a photocopying machine.

6. A document with anti-counterfeiting means to prevent reproducibility by photocopying, comprising a sheet-like element having, on its face, at least one region whereon an image that is not visible in the visible-light range is printed and has, on the back, in register with said image provided on the face, the same image, printed with an ink that is not visible in the visible-light range, said image printed on the back of the sheet-like element and the image printed on the face of the sheet-like element being printed such that the two images are one coincident with the other.

7. A document according to claim 6, wherein said ink that is not visible in the visible-light range is constituted by an ink visible in ultraviolet light.

8. A document according to claim 6, wherein said ink has different colorings in laterally adjacent regions.

9. A document according to claim 6, wherein said image provided on the back is visible by lighting with an ultraviolet-light lamp.

10. A document according to claim 6, wherein said image provided on the back cannot be reproduced by photocopying machine.

* * * * *